US007395923B2

(12) United States Patent
Chou

(10) Patent No.: US 7,395,923 B2
(45) Date of Patent: Jul. 8, 2008

(54) CONTAINER HAVING THE FUNCTION OF ABSORBING BLOOD AND WATER OF FRESH FOOD

(76) Inventor: Hsin-Hung Chou, No. 2, Alley 2, Lane 250, Wen Chan Street, Taipei City (TW)

( * ) Notice: Subject to any disclaimer, the term of this patent is extended or adjusted under 35 U.S.C. 154(b) by 369 days.

(21) Appl. No.: 11/221,725

(22) Filed: Sep. 9, 2005

(65) Prior Publication Data

US 2007/0056863 A1 Mar. 15, 2007

(51) Int. Cl.
*B65D 81/26* (2006.01)

(52) U.S. Cl. ..... 206/204; 206/557; 426/124; 426/129

(58) Field of Classification Search ..... 206/204, 206/205, 557; 229/406, 407; 426/106, 124, 426/129, 326

See application file for complete search history.

(56) References Cited

U.S. PATENT DOCUMENTS 3,834,606 A * 9/1974 Andersson ..... 229/406
4,869,387 A * 9/1989 Persson ..... 62/371
RE33,143 E * 1/1990 Grone ..... 206/557
6,223,894 B1 * 5/2001 Lemaire ..... 206/204
6,983,575 B2 * 1/2006 Longo ..... 53/432
7,175,021 B2 * 2/2007 Colombo ..... 206/204
2004/0195115 A1 * 10/2004 Colombo ..... 206/204
2006/0219578 A1 * 10/2006 Owensby ..... 206/204
2007/0039838 A1 * 2/2007 Bagley ..... 206/204

* cited by examiner

*Primary Examiner*—David T Fidei
(74) *Attorney, Agent, or Firm*—Rosenberg, Klein & Lee

(57) ABSTRACT

A container having the function of absorbing blood and water of fresh food includes a lower box body, an opening, a lower latch member at the periphery of the opening, a recessed surface at an internal bottom an absorbent material flatly disposed in the recessed surface, and an upper box body corresponding to a lower box body. The lower box body includes an opening, an upper latch member at the periphery of the opening, a plurality of through holes disposed at the bottom corresponding to the absorbent material, and the upper box body is sheathed into the lower box body, and the upper latch member is latched onto the lower latch member, so that the upper and lower box bodies are combined into a double-layer box and the absorbent material is included inside. Further, the lower box body includes a plurality of longitudinal ribs on its internal side wall and perpendicularly contacted with a plurality of transversal ribs on the external sidewall of the upper box body. The invention can prevent filthy water or blood from flowing into the tray or damaging the freshness of the food.

7 Claims, 4 Drawing Sheets

CONTAINER HAVING THE FUNCTION OF ABSORBING BLOOD AND WATER OF FRESH FOOD

BACKGROUND OF THE INVENTION

1. Field of the Invention

The invention relates to a packaging container having the function of absorbing blood and water of fresh food, and more particularly to a packaging container capable of preventing the blood or filthy water of beef, fresh fish, chicken or the like from remaining in the packaging container that may affect the appearance and sanitation of the packaged food due to the decomposition of the meat products.

2. Description of the Related Art

In general, most fresh food including beef, fresh fish, seafood, chicken and the like displayed in fresh produce supermarkets, hypermarkets and large malls for user's choice are wrapped by stretch wrapping. The fresh food contained in a tray made of Styrofoam and then wrapped by stretch wrapping are displayed in the stores for consumers to buy, but the fresh food may have water or the meat products may have blood remaining from the decomposition of the food, and the water and blood will remain in the tray and mix with the fresh food. Such arrangement not only causes the meat products or other fresh food to get rotten easily, but also gives a bad image to the packaged food.

Referring to FIGS. 1 and 2 for a prior art fresh food packaging container, an absorbent pad 42 is placed on a tray 41, and the fresh food is placed on the absorbent pad 42. Although the absorbent pad 42 can absorb the blood or water of the fresh food, excessive blood or water will remain in the tray 41 if the absorbent pad 42 is saturated. As a result, the blood or filthy water will be mixed with the fresh food, and such packaging container is definitely not a good one.

Further, high-price meat products or fishes such as Japanese Matsuka beef or blue fin tuna (Toro) should be packaged with a package container unlike the traditional packaging in order to attract consumers to buy. At present, a transparent freshness maintaining box is usually used to package these high-price meat products and fishes, and a plastic blade or a bamboo or wooden slice is put at the inner bottom of the container for decoration, but such arrangement cannot prevent blood or water from coming out from the meat products and fishes. The blood or water may flow to the tray and mix with the fresh food. Such arrangement not only causes meat products and fishes to get rotten easily, but also affects the appearance and the sanitation of the food. As a result, these high-price fresh foods no longer look so good and thus affecting the consumer's willingness for its purchase.

In view of the foregoing shortcomings of the prior art, the inventor of the present invention conducted extensive experiments and tests to overcome the shortcomings and improve the function of the packaging container.

SUMMARY OF THE INVENTION

A primary object of the invention to provide a packaging container having a function of absorbing blood and water of fresh food, and the packaging container includes an absorbent material to improve the function of preventing blood and water from coming out of the fresh food.

Another object of the present invention to provide a packaging container having the function of preventing blood and water of the fresh food, and the packaging container forms a recessed surface at the bottom of the container for placing an absorbent material onto the recessed surface to fix the absorbent material.

A further object of the present invention is to provide a packaging container having the function of absorbing blood and water of the fresh food, and the transversal ribs and longitudinal ribs disposed on the internal and external sidewalls of the upper and lower box bodies are perpendicular with each other for storing extra blood and water, and thus can prevent the blood and water from overflowing to the surface of the tray, permeating into the fresh food, or making the food to get rotten easily.

In order to achieve the above-mentioned objects, a packaging container having the function of absorbing blood and water of the fresh food comprises:

a) a lower box body having an opening formed thereon and a lower latch member disposed at the periphery of the opening, a recessed surface being formed at the bottom of the lower box body;

b) an absorbent material flatly disposed onto the recessed surface; and c) an upper box body corresponding to the lower box body and having an opening thereon, an upper latch member being disposed at the periphery of the opening, and a plurality of through holes being disposed at the bottom of the upper box body corresponding to the absorbent material, and the upper box body being sheathed into the lower box body, such that the upper latch member is latched to the lower latch member, and the upper and lower box bodies are coupled to define a double-layer box that contains the absorbent material in between.

BRIEF DESCRIPTION OF THE FIG.S

DETAILED DESCRIPTION OF THE PREFERRED EMBODIMENT

Figure 1:
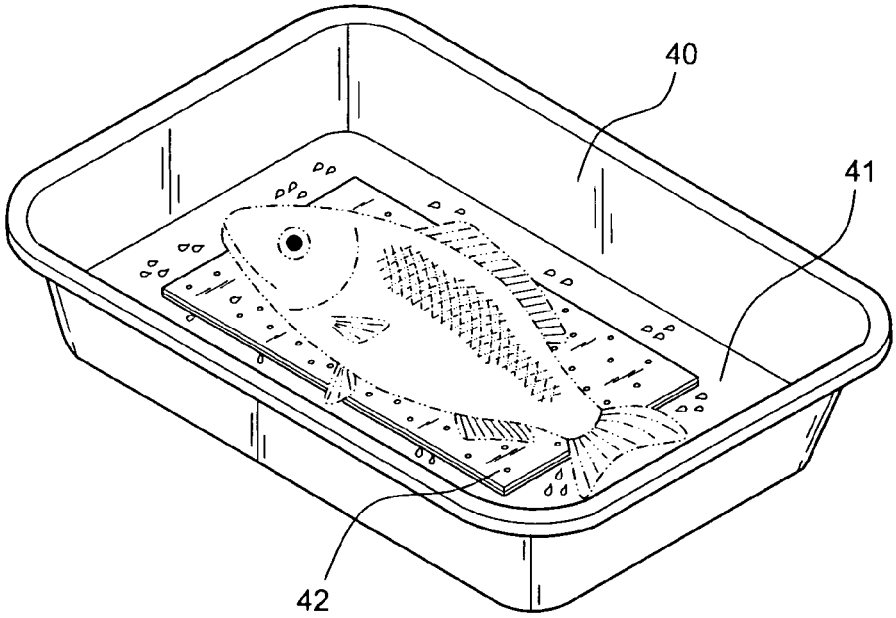
FIG.1 PRIOR ART
FIG. 1 is a perspective view of a prior art food container.
Figure 2:
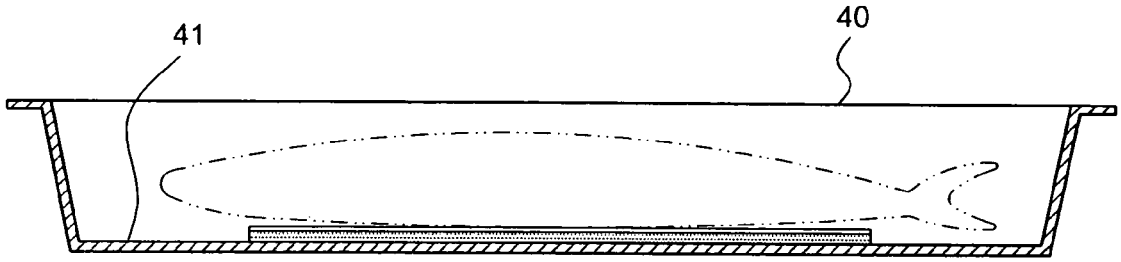
FIG.2 PRIOR ART
FIG. 2 is a side view of a prior art food container.
Figure 3:
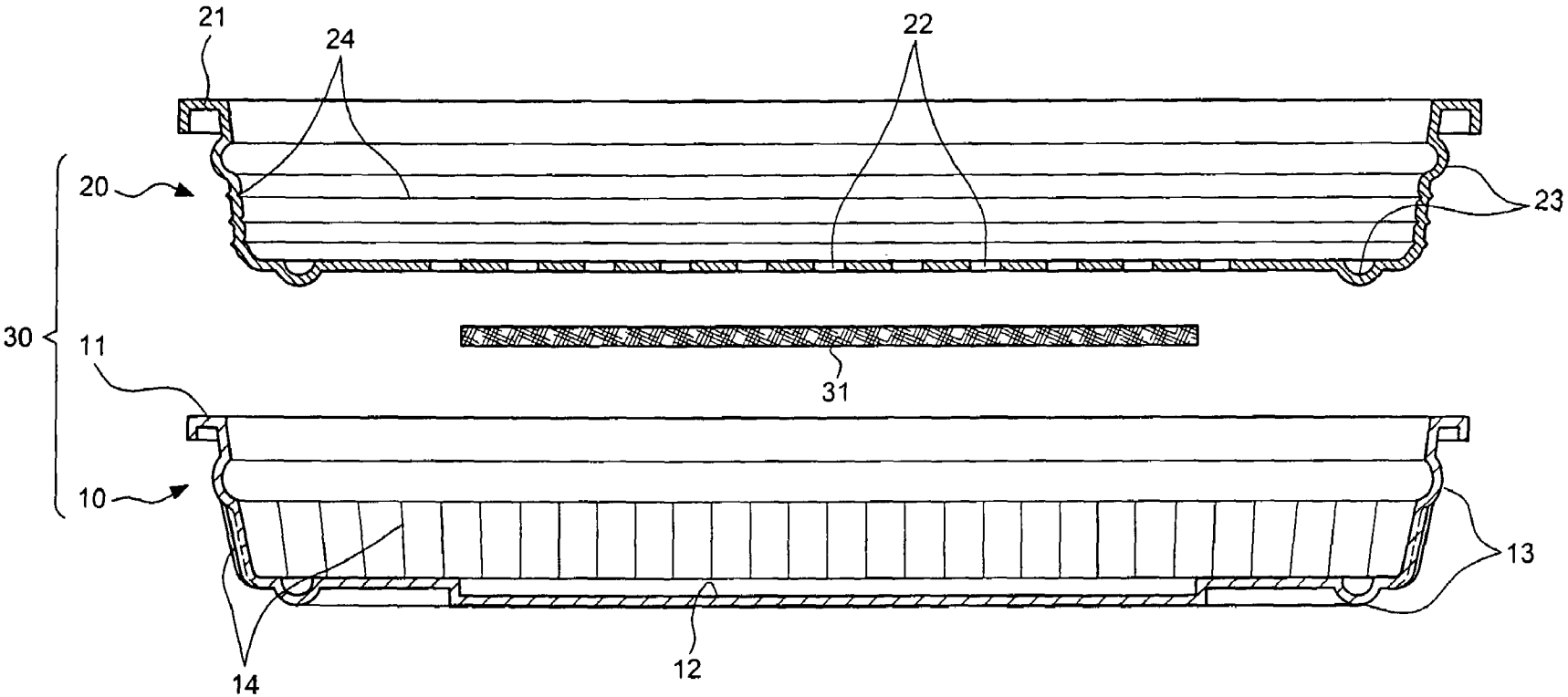
FIG. 3 is a schematic of disassembled parts of the invention.
Figure 4:
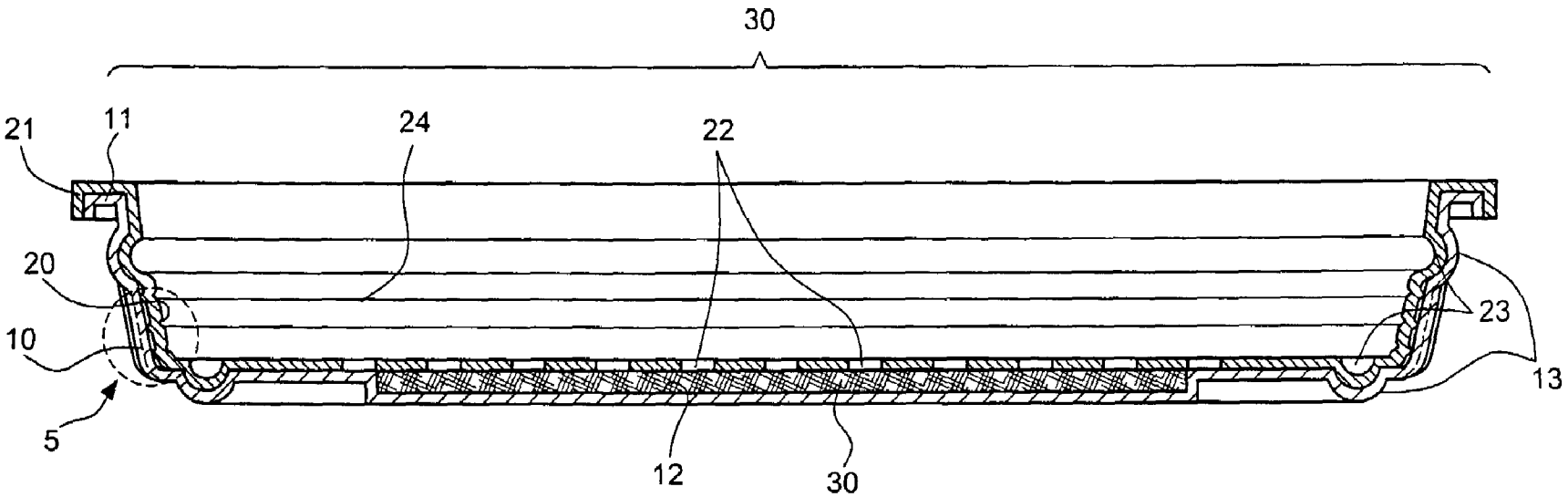
FIG. 4 is a schematic view of an assembled structure of the invention.

Referring to FIGS. 3 and 4, a container having the function of absorbing blood and water of fresh food in accordance with the present invention comprises: a lower box body 10, an opening disposed thereon, a lower latch member 11 disposed at the periphery of the opening, an upper box body 20 corresponding to the lower box body 10 and having an opening thereon, and an upper latch member 21 disposed at the periphery of the opening. The upper box body 20 is sheathed into the lower box body 10, and the upper latch member 21 is latched onto the lower latch member 11, and the upper and lower latch members 21, 11 are n-shaped members, such that the upper and lower box bodies 20, 10 are combined into a double-layer box 30, and an absorbent material 31 is included between the upper and lower box bodies 20, 10.

Further, the upper and lower box bodies 20, 10 are made of polystyrene (PS) material by injection molding and formed by a thermal pressing process, so that the upper and lower box bodies 20, 10 can be secured without getting separated from each other or damaged easily.

Further, at least one rib 13 disposed at the bottom and lateral side of the lower box body 10 is coupled with a rib 23 disposed at the corresponding bottom and lateral side of the upper box body 20, so that the upper and lower ribs 23, 13 are latched, and the double-layer box 30 can be secured and will not fall apart easily.

The lower box body 10 includes a recessed surface 12 at its bottom, and the recessed surface 12 has an absorbent material 31 thereon, and the absorbent material 31 is flatly placed on the recessed surface 12, so that the absorbent material can be secured onto the recessed surface 12 without moving easily.

The foregoing absorbent material 31 is composed of unwoven cloth, yarn, cotton, sponge, fiber cloth, or their combinations for absorbing the blood and water of the fresh food, so that the blood and water can be separated from the fresh food to maintain the freshness of the fresh food. The absorbent material 31 includes a plurality of through holes 22, and thus the blood and water of the fresh food can be discharged from the through holes 22 and will not remain in the tray containing the fresh food that may cause the fresh food to get rotten.

Figure 5:
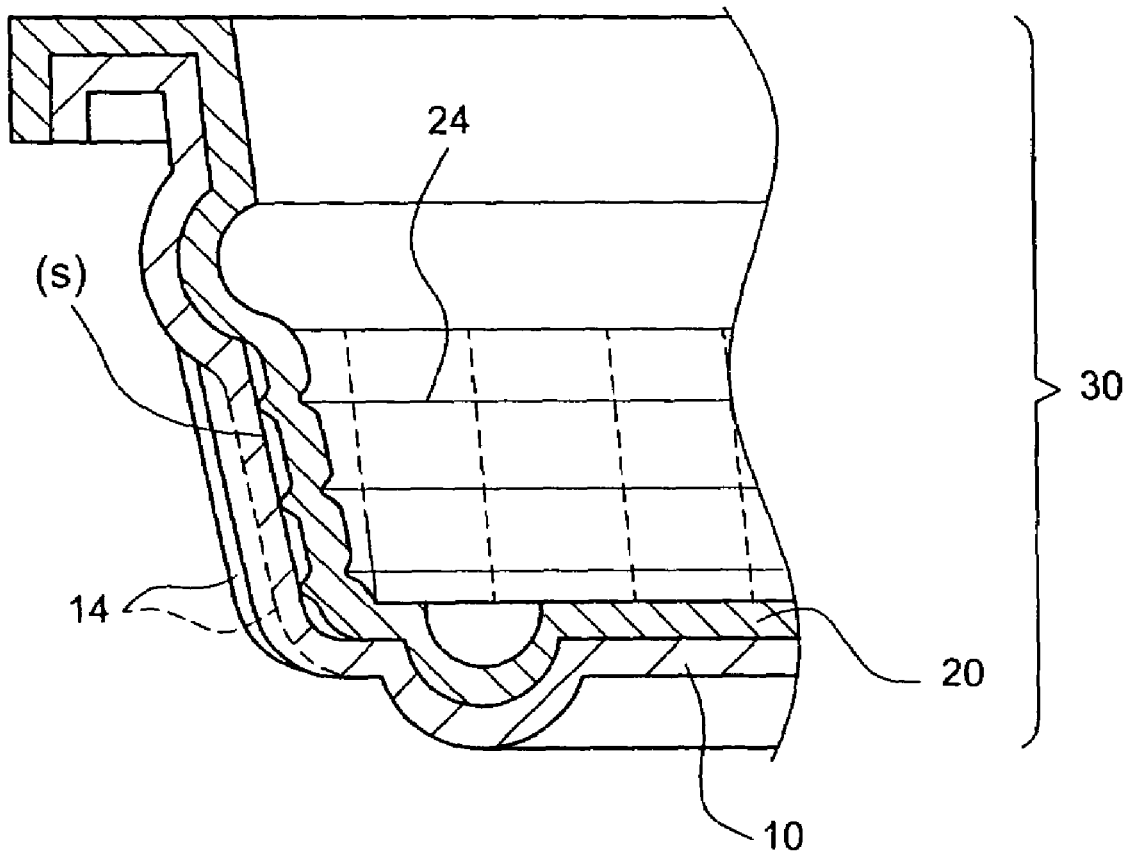
FIG. 5 is an enlarged view of a part of the structure as depicted in FIG. 4.

Further, another preferred embodiment of the present invention comprises a plurality of longitudinal ribs 14 disposed on the internal sidewall of the lower box body 10 and a plurality of transversal ribs disposed on the external sidewall of the upper box body 20 and perpendicular with the longitudinal ribs 14. Such arrangement not only increases the strength of the upper and lower box bodies 20, 10, but also prevents the box bodies from being falling apart easily when accessing the box body. More importantly, an air accommodating space S is formed as shown in FIG. 5, such that when the blood and water of fresh food no longer can be absorbed by the absorbent material 31, the blood or filthy water will flow into the space S in contact with the mutually perpendicular longitudinal ribs 14 and transversal ribs 24, so as to further prevent the blood and water from overflowing to the surface of tray that contains the fresh food, and prevent the fresh food from getting rotten due to the blood and filthy water. If the fresh food with the blood and filthy water is displayed in a supermarket, its overall appearance is not clean or sanitary, and thus reducing the consumer's willingness for the purchase. The design of the longitudinal ribs 14 and the transversal ribs 24 can further separate the blood and filthy water and prevent them from mixing with the fresh food, so as to maintain the freshness of the food as well as the overall appearance of the packaged food.

The foregoing technological measures can overcome the shortcomings of the traditional food containers and achieve the sanitary effect. After fresh fish or meat is packaged into the box, the surface is wrapped with a transparent thin membrane manually or mechanically. However, these skills are prior arts, and thus will not be described hereinafter.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A container having the function of absorbing blood and water of fresh food, comprising:

a) a lower box body having an opening formed thereon and a lower latch member disposed at a periphery of the opening of the lower box body, a recessed surface being formed at a bottom of the lower box body;

b) an absorbent material flatly disposed onto the recessed surface; and c) an upper box body corresponding to the lower box body and having an opening thereon, an upper latch member being disposed at a periphery of the opening of the upper box body, and a plurality of through holes being disposed at a bottom of the upper box body corresponding to the absorbent material, and the upper box body being sheathed into the lower box body, such that the upper latch member is latched to the lower latch member, and the upper and lower box bodies are coupled to define a double-layer box that contains the absorbent material in between.

2. The container having the function of absorbing blood and water of fresh food as recited in claim 1, wherein the lower box body is made of a polystyrene (PS) material and formed by injection molding.

3. The container having the function of absorbing blood and water of fresh food as recited in claim 1, wherein the upper and lower box bodies are manufactured by thermal pressing.

4. The container having the function of absorbing blood and water of fresh food as recited in claim 1, wherein the absorbent material is made of material selected from a group consisting of unwoven cloth, yam, cotton, sponge, and fiber cloth, or a combination thereof.

5. The container having the function of absorbing blood and water of fresh food as recited in claim 1, wherein the lower box body further comprises at least one lower rib disposed at the bottom and lateral side of the lower box body and coupled to an upper rib disposed at the corresponding bottom and lateral side of the upper box body.

6. The container having the function of absorbing blood and water of fresh food as recited in claim 1, wherein the upper and lower latch members are formed in an n-shape.

7. A container having the function of absorbing blood and water of fresh food, comprising:

a) a lower box body having an opening formed thereon and a lower latch member disposed at a periphery of the opening of the lower box body, a recessed surface being formed at a bottom of the lower box body, a plurality of longitudinal ribs being provided at an internal sidewall of the lower box body;

b) an absorbent material flatly disposed onto the recessed surface; and c) an upper box body corresponding to the lower box body and having an opening thereon, an upper latch member being disposed at a periphery of the opening of the upper box body, and a plurality of through holes being disposed at a bottom of the upper box body corresponding to the absorbent material, and the upper box body being sheathed into the lower box body, such that the upper latch member is latched to the lower latch member, and the upper and lower box bodies are coupled to define a double-layer box that contains the absorbent material in between, the upper box body further including a plurality of transversal ribs disposed at an externa1 sidewall of the upper box body and perpendicularly in contact with the internal sidewall of the longitudinal ribs of the lower box body.

* * * * *